US006102979A

United States Patent [19]

Bianco et al.

[11] Patent Number: 6,102,979

[45] Date of Patent: Aug. 15, 2000

[54] OXIDE STRENGTHENED MOLYBDENUM-RHENIUM ALLOY

[75] Inventors: Robert Bianco, Cleveland, Ohio; R. William Buckman, Jr., Pittsburgh, Pa.

[73] Assignee: The United States of America as represented by the United States Department of Energy, Washington, D.C.

[21] Appl. No.: 09/143,055

[22] Filed: Aug. 28, 1998

[51] Int. Cl.[7] ..... C22C 29/12

[52] U.S. Cl. ..... 75/232

[58] Field of Search ..... 75/232, 235; 420/429; 419/20, 34, 38

[56] References Cited

U.S. PATENT DOCUMENTS

| | | | |
|---|---|---|---|
| 4,115,113 | 9/1978 | Fustier et al. | 75/206 |
| 4,622,068 | 11/1986 | Rowe et al. | 75/245 |
| 4,950,327 | 8/1990 | Eck et al. | 75/232 |
| 5,049,355 | 9/1991 | Gennari et al. | 420/425 |
| 5,051,139 | 9/1991 | Eck . | |
| 5,102,474 | 4/1992 | Eck et al. | 148/11.5 P |
| 5,263,349 | 11/1993 | Felix et al. | 72/38 |
| 5,372,661 | 12/1994 | Felix et al. . | |
| 5,401,307 | 3/1995 | Czech et al. . | |
| 5,437,744 | 8/1995 | Carlen . | |
| 5,476,632 | 12/1995 | Shivanath et al. . | |
| 5,529,602 | 6/1996 | Ishii et al. . | |
| 5,540,790 | 7/1996 | Erickson . | |
| 5,582,635 | 12/1996 | Czech et al. . | |
| 5,590,392 | 12/1996 | Ishiwata et al. | 428/546 |
| 5,606,141 | 2/1997 | Leichtfried | 75/235 |
| 5,868,876 | 2/1999 | Bianco et al. | 148/407 |
| 5,928,799 | 7/1999 | Sherman et al. . | |
| 5,935,351 | 8/1999 | Sherman et al. . | |

OTHER PUBLICATIONS

NASA Technical Memorandum, NASA TM X–2576, "Mechanical Properties of Electron–Beam–Melted Molybenum and Dilute Molybdenum–Rhenium Alloys", William D. Klopp and Walter R. Witzke, Lewis Research Center, Jun. 1972.

Defense Metals Information Center (DMIC), Report 140, "Physical and Mechanical Properties of Commercial Molybdenum—Base Alloys", J.A. Houck, pp. 44, 57 and 58, Battelle Memorial Inst. Columbus, Ohio, Nov. 1960.

*Primary Examiner*—Daniel J. Jenkins
*Attorney, Agent, or Firm*—Virginia B. Caress; William R. Moser; Paul A. Gottlieb

[57] ABSTRACT

Provided is a method of making an ODS molybdenum-rhenium alloy which includes the steps of:

(a) forming a slurry containing molybdenum oxide and a metal salt dispersed in an aqueous medium, the metal salt being selected from nitrates or acetates of lanthanum, cerium or thorium;

(b) heating the slurry in the presence of hydrogen to form a molybdenum powder comprising molybdenum and an oxide of the metal salt;

(c) mixing rhenium powder with the molybdenum powder to form a molybdenum-rhenium powder;

(d) pressing the molybdenum-rhenium powder to form a molybdenum-rhenium compact;

(e) sintering the molybdenum-rhenium compact in hydrogen or under a vacuum to form a molybdenum-rhenium ingot; and (f) compacting the molybdenum-rhenium ingot to reduce the cross-sectional area of the molybdenum-rhenium ingot and form a molybdenum-rhenium alloy containing said metal oxide.

The present invention also provides an ODS molybdenum-rhenium alloy made by the method. A preferred Mo—Re-ODS alloy contains 7–14 weight % rhenium and 2–4 volume % lanthanum oxide.

32 Claims, 4 Drawing Sheets

OXIDE STRENGTHENED MOLYBDENUM-RHENIUM ALLOY

RIGHTS OF THE GOVERNMENT

The United States Government has rights in this invention pursuant to a contract awarded by the Department of Energy.

FIELD OF THE INVENTION

The present invention relates to a molybdenum-rhenium alloy having improved high temperature resistance, ductility and strength. The present invention also relates to a method of making the molybdenum-rhenium alloy.

BACKGROUND OF THE INVENTION

Molybdenum-base alloys have been used for high temperature applications, such as furnace heating elements, radiant heat shields, susceptor rings for induction furnaces, electrical posts for lamp filaments, high-temperature springs, high-strength fiber reinforcements, high-strength dies, high-strength tubing for ballistic applications, and creep resistant boats for sintering. Molybdenum-base alloys can be strengthened by solid-solution strengthening, precipitation or dispersion strengthening, strain or work hardening and grain size refining, and retaining a fine-grained worked microstructure to high temperatures. For service at elevated temperatures, only the last three or a combination on any of them have the potential for success.

Commercial molybdenum-base alloys generally do not possess sufficient creep and tensile strength to survive operating temperatures above 1315° C. Molybdenum TZM and TZC alloys, strengthened by a combination of alloying, such as solid-solution strengthening, and carbide particles, precipitation strengthening, plus thermomechanical processing, experience substantial degradation of their mechanical properties above 1315° C. This led to the development of an oxide dispersion strengthened (hereinafter "ODS") molybdenum alloy, which provides enhanced stability at temperatures above 1315° C. ODS molybdenum alloy is formed by the following steps:

- a slurry is first formed by dispersing molybdenum oxide and a metal salt in an aqueous medium, the metal oxide being selected from nitrates and acetates of lanthanum, cerium or thorium;
- the slurry is then heated in the presence of hydrogen to form a molybdenum powder and a metal oxide;
- the molybdenum powder is pressed to form a molybdenum compact;
- the molybdenum compact is sintered in the presence of hydrogen to form a molybdenum ingot; and
- the molybdenum ingot is compacted to reduce the cross-sectional area of the molybdenum ingot and form an ODS molybdenum alloy containing a metal oxide.

The creep-rupture life of unalloyed molybdenum at 0.65 $T_m$ (1600° C.) is increased by approximately 4 to 5 orders of magnitude by using the ODS method.

Other attempts to improve the high temperature properties of molybdenum include adding rhenium at amounts up to 50% by weight. U.S. Pat. No. 5,437,744 discloses a molybdenum-rhenium alloy which contains 42 up to less than 45% by weight rhenium. This patent does not disclose a molybdenum-rhenium alloy containing La, Ce, or Th, which has been formed using the ODS method described above. The creep-rupture life of unalloyed molybdenum at 0.65 $T_m$ (1600° C.) is only increased by approximately one order of magnitude with up to 50% by weight addition of rhenium.

While ODS molybdenum alloy provides enhanced stability at elevated temperatures, there is still a great need for further improvements in the high temperature stability of ODS molybdenum.

SUMMARY OF THE INVENTION

An objective of the present invention is to provide a method of making an ODS molybdenum-rhenium alloy having enhanced stability at temperatures above 1315° C., enhanced ductility and improved strength.

Another objective of the present invention to provide an ODS molybdenum-base alloy having enhanced stability at temperatures above 1315° C., enhanced ductility and improved strength.

The above objectives and other objectives are surprisingly obtained by the novel method of making an ODS molybdenum-rhenium alloy which includes the steps of:

(a) forming a slurry comprising molybdenum oxide and a metal salt dispersed in an aqueous medium, the metal salt being selected from nitrates or acetates of lanthanum, cerium or thorium;

(b) heating the slurry in the presence of hydrogen to form a molybdenum powder comprising molybdenum and an oxide of the metal salt;

(c) mixing rhenium powder with the molybdenum powder to form a molybdenum-rhenium powder;

(d) pressing the molybdenum-rhenium powder to form a molybdenum-rhenium compact;

(e) sintering the molybdenum-rhenium compact in the presence of hydrogen or a vacuum to form a molybdenum-rhenium ingot; and (f) compacting the molybdenum-rhenium ingot to reduce the cross-sectional area of the molybdenum-rhenium ingot and form a molybdenum-rhenium alloy containing said metal oxide.

The present invention also provides a novel molybdenum-rhenium alloy having enhanced strength and ductility comprising molybdenum, rhenium and a metal oxide selected from oxides of lanthanum, cerium or thorium, the molybdenum-rhenium alloy being formed by the method comprising the steps of:

(a) forming a slurry comprising molybdenum oxide and a metal salt dispersed in an aqueous medium, the metal salt being selected from nitrates or acetates of lanthanum, cerium or thorium made;

(b) heating the slurry in the presence of hydrogen to form a molybdenum powder comprising molybdenum and the metal oxide;

(c) mixing rhenium powder with the molybdenum powder to form a molybdenum-rhenium powder;

(d) pressing the molybdenum-rhenium powder to form a molybdenum-rhenium compact;

(e) sintering the molybdenum-rhenium compact in the presence of hydrogen or under a vacuum to form a molybdenum-rhenium ingot; and (f) compacting the molybdenum-rhenium ingot to reduce the cross-sectional area of the molybdenum-rhenium ingot and form the molybdenum-rhenium alloy containing the metal oxide.

DETAILED DESCRIPTION OF PREFERRED EMBODIMENTS

Figure 1:
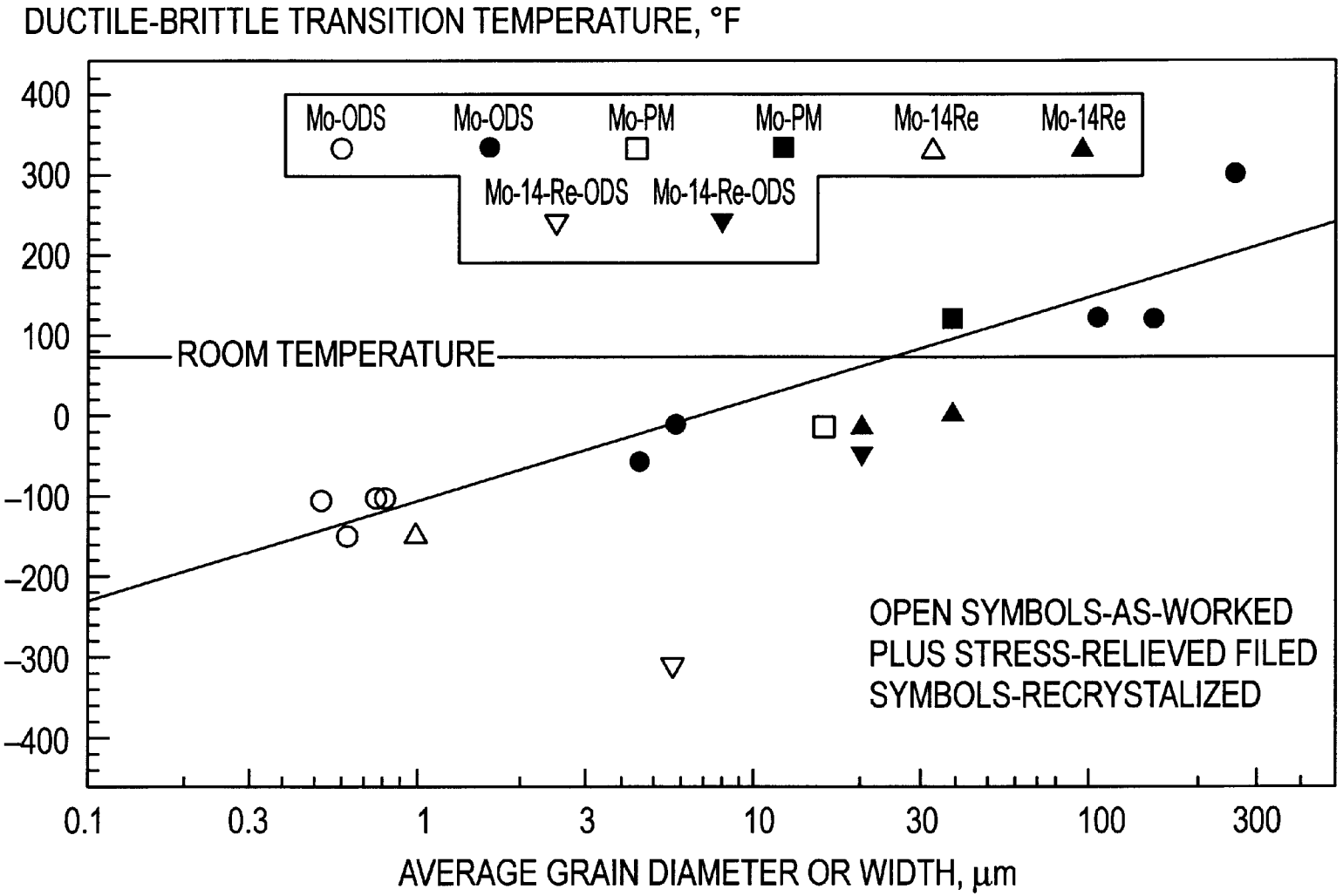
FIG. 1 illustrates a graph of the ductile-to-brittle transition temperature as a function of average grain diameter or width for worked and recrystallized molybdenum and alloys thereof.

The invention provides a novel ODS molybdenum-rhenium alloy containing a dispersion of fine metal oxide particles. The metal oxide is at least one oxide of lanthanum, cerium or thorium. Preferably, the metal oxide is an oxide of lanthanum. The metal oxide can be present in an amount of about 2% to about 6% by volume (about 1–6% by weight depending on the particular metal oxide), preferably from about 2% to about 4%, based on the total volume of the molybdenum-rhenium alloy. Rhenium is present in an amount from about 5% to about 25%, and more preferably from about 7% to about 14% by weight, based on the total weight of the molybdenum-rhenium alloy.

The ODS molybdenum-rhenium alloy provides enhanced ultimate tensile stress in combination with enhanced ductility over a broad range of temperatures. The ODS molybdenum-rhenium alloy is capable of providing ultimate tensile stresses of greater than 120 ksi, preferably at least about 129 ksi, and more preferably at least about 150 ksi, in combination with exhibiting a ductile-to-brittle transition temperature of below −100° F., preferably below about −200° F., and most preferably below about −300° F. Thus, the ODS molybdenum-rhenium alloy is well suited for high temperature applications, such as furnace heating elements, radiant heat shields, susceptor rings for induction furnaces, electrical posts for lamp filaments, high-temperature springs, high-strength fiber reinforcements, high-strength dies, high-strength tubing for ballistic applications, and creep resistant boats for sintering.

The ODS molybdenum-rhenium alloy can be formulated by an improved ODS method including the steps of:

(a) forming a slurry comprising molybdenum oxide and a metal salt dispersed in an aqueous medium, the metal salt being selected from nitrates or acetates of lanthanum, cerium or thorium;

(b) heating the slurry in the presence of hydrogen to form a molybdenum powder comprising molybdenum and an oxide of the metal salt;

(c) mixing rhenium powder with the molybdenum powder to form a molybdenum-rhenium powder;

(d) pressing the molybdenum-rhenium powder to form a molybdenum-rhenium compact;

(e) sintering the molybdenum-rhenium compact in hydrogen or under a vacuum to form a molybdenum-rhenium ingot; and (f) compacting the molybdenum-rhenium ingot to reduce the cross-sectional area of the molybdenum-rhenium ingot and form a molybdenum-rhenium alloy containing the metal oxide.

The slurry can be formed in step (a) using any conventional method for forming a slurry. The preferred aqueous medium is water. The metal salt can be added in an amount which provides from about 2–6% by volume (about 1–6% by weight), preferably from about 2–4% by volume. The preferred metal salt is lanthanum salt.

The heating step (b) should be conducted at a temperature and for a time period sufficient to obtain substantially complete reduction of the molybdenum oxide to molybdenum metal and convert the metal salt to the corresponding metal oxide. One skilled in the art will easily be able to determine when complete reduction has been reached by the color and weight change of the powder. Suitable temperatures have been found to be from about 500 to about 1000° C., preferably from about 600 to about 700° C., for from about 6 hours to about 24 hours, with lower temperatures requiring longer times. Preferably, the slurry is pre-dried at a temperature of from about 125 to about 150° C. to remove most of the aqueous liquid, before raising the temperature to reduce the molybdenum oxide.

The rhenium powder should be sufficiently mixed with the molybdenum and metal oxide during step (c) to form a homogenous mixture. Any suitable method for forming a homogeneous mixture can be utilized. For example, ball milling the mixture for at least about 18 hours has been found to be suitable for forming a homogeneous mixture. The rhenium oxide can be added in an amount which provides from about 5% to about 25%, more preferably from about 7% to about 14% by weight rhenium metal, based on the total weight of the molybdenum-rhenium alloy.

The pressing step (d) should be conducted in a manner which provides a compact suitable for sintering. The formation of compacts is well known in the art and one skilled in the art will be able to form the desired size compact without undue experimentation. For example, to form a 1.5 inch diameter cylindrical compact, suitable pressures have been found to be at least about 30 ksi, preferably from about 30 to about 40 ksi, for at least about 5 minutes, preferably from about 5 minutes to about 150 minutes.

Preferably, the sintering step (e) is conducted at a temperature and for a time period sufficient to provide a density of greater than about 90%, preferably greater than about 97%, of the theoretical density of molybdenum. For a molybdenum-rhenium alloy containing lanthanum oxide, suitable sintering temperatures in an atmosphere of hydrogen or vacuum have been found to be from about 1900 to about 1950° C. for from about 2 to about 7 hours, preferably at least about 4 hours. If desired, the compact can be cleaned in a hydrogen containing atmosphere before the sintering step (e). Suitable cleaning temperatures are from about 500 to about 1200° C., for from about 2 to about 7 hours, preferably at least about 4 hours.

The compacting step (f) can be conducted in any suitable manner to provide the desired level of total reduction in area. Examples include, but are not limited to, hand swaging, machine swaging, extruding, or drawing. Preferably, the ingot is heated before or during the compacting step (f) to provide thermomechanical processing. The desired temperature will depend on the type of thermomechanical processing utilized. For example, suitable temperatures for extrusion include from about 600 to about 1500° C. A preferred method of compacting the ingot comprises the steps of cladding the ingot; heating the clad ingot to about 1350° C. for at least about 30 minutes, extruding the ingot, and then hand-swaging. Preferably, the compacting step is conducted such that the total reduction in cross-sectional area is at least about 90%, preferably at least about 98%. The total reduction in cross-sectional area ("RA") can be determined by the following formula:

$$\%RA=(A_0-A_f)/A_0\times 100\%$$

where $A_0$ is the initial area and $A_f$ is the final area after compacting.

The invention will now be described in further detail with reference to the following non-limiting examples.

Examples 1 through 3 and Control

Three ODS molybdenum-rhenium alloys were produced according to the present invention having the components shown in Table 1. One ODS molybdenum alloy control was formed having the components shown in Table 1.

TABLE 1

| | Average Alloy Content (wt. % based on total weight of alloy) | | | | |
|---|---|---|---|---|---|
| | Molybdenum | Rhenium | Lanthanum* | Oxygen* | Carbon |
| Control | Balance | 0 | 0.73 | 0.36 | 0.009 |

TABLE 1-continued

| | Average Alloy Content (wt. % based on total weight of alloy) | | | | |
|---|---|---|---|---|---|
| | Molybdenum | Rhenium | Lanthanum* | Oxygen* | Carbon |
| Example 1 | Balance | 14.7 | 0.76 | 0.35 | 0.015 |
| Example 2 | Balance | 14.9 | 0.7 | 0.33 | 0.018 |
| Example 3 | Balance | 7 | 0.67 | 0.36 | 0.016 |

*Equivalent to 1 wt. % $La_2O_3$ in alloy.

The examples and control were formed using the following method. Molybdenum dioxide, $MoO_2$, powder and an aqueous lanthanum nitrate solution were mixed to form a slurry. The slurry was pre-dried at about 125° C. to about 150° C. and then heated to about 650° C. to about 690° C. for at least six hours in a dry, flowing hydrogen atmosphere to pyrolyze the lanthanum nitrate salt to lanthanum oxide particles, and to reduce the molybdenum dioxide powder to metallic molybdenum. In examples 1 through 3, rhenium powder, having an average particle size of 5 microns, was combined with the reduced and pyrolyzed molybdenum powder and mixed thoroughly using a ball mill for at least 18 hours to form a homogeneous molybdenum-rhenium powder. The control was treated similarly, except that no rhenium powder was added. The molybdenum-rhenium powders and control molybdenum powder were cold isostatically pressed (CIP) into 1.5 inch diameter cylindrical compacts using about 30 to about 40 ksi pressure for at least about 15 minutes. The compacts were cleaned in flowing dry hydrogen at about 1100° C. for at least about four hours, and then sintered in a dynamic vacuum ($<10^{-5}$ torr) at about 1950° C. for at least about four hours, to form molybdenum-rhenium ingots and a molybdenum ingot. Each molybdenum-rhenium ingot and molybdenum ingot was placed into a separate unalloyed molybdenum extrusion canister and sealed by tack welding on a lid. Each canister was preheated in flowing dry hydrogen at about 1350° C. for at least about 30 minutes and then dynamically compacted at about a 6:1 reduction ratio using a high-rate extrusion press to form a molybdenum-rhenium alloy containing lanthanum oxide and a molybdenum alloy containing lanthanum oxide. Each molybdenum-rhenium alloy and molybdenum alloy was preheated in flowing dry hydrogen and hand swaged to a 0.200 inch diameter with the molybdenum cladding in place. The cladding was removed by centerless grinding, producing alloy rods having a 0.180 inch diameter. The details of each processing step are disclosed in Table 2.

TABLE 2

| Process Step | Diameter (inch) | Incremental Reduction in Area (%) | Total Reduction in Area by Working (%) | Preheat Temperature (° C.) |
|---|---|---|---|---|
| Initial | 2 | — | — | — |
| Cold Isostatic Pressing | 1.7 | 28 | — | 20 |
| Hydrogen Cleaning | 1.65 | 6 | — | 1100 |
| Vacuum Sintering | 1.5 | 17 | — | 1950 |
| Extrusion | 0.612 | 83 | 83 | 1350 |
| Hand Swaging* | 0.403 | 57 | 93 | 1200 |
| | 0.302 | 44 | 96 | 1000 |
| | 0.188 | 61 | 98 | 800 |
| Declading and Trimming | 0.180 | Not Applicable | Not Applicable | 21 |

*Several passes with no one pass resulting in greater than 15% reduction in area.

The chemical composition of each powder mixture was measured using both inert gas fusion and plasma spectrometry techniques. The results for the control molybdenum alloy (hereinafter "Mo-ODS alloy) and each molybdenum-rhenium alloy (hereinafter "Mo—Re-ODS alloy) are shown in Table 3. The microstructural properties of the Mo—Re-ODS alloys are also shown in Table 3 and compared with typical characteristics of unalloyed molybdenum (PM-Mo), Mo-14 Re (solid-solution) alloy, and the Mo-ODS alloy. The microstructures of the Mo—Re-ODS alloys in the as-swaged condition exhibited elongated grains having average widths of about 0.3 mils (8 $\mu$m) and 0.2 mils (5 $\mu$m) for the Mo-7 ReODS and Mo-14 Re-ODS alloys, respectively. The average aspect ratio (average grain length/width) for the as-swaged alloys was 10 (Mo-7 Re-ODS) and 5 (Mo-14 Re-ODS). Both agglomerates and discrete oxide particles were observed in the microstructures of the two new Mo—Re-ODS alloys. It is believed that agglomerates and coarser oxide particles may have contributed to the larger grain size in the Mo—Re-ODS alloys.

TABLE 3

| Alloy | Average Grain Width (mils) | Average Oxide Particle Size (mils) | Average Vickers Hardness ($kg/mm^2$) |
|---|---|---|---|
| ODS Mo, 7% Re | 0.3 | 0.06 | 260 |
| ODS Mo, 14% Re | 0.2 | 0.16 | 305 |
| Unalloyed PM Mo | 0.6 | n/a | 225 |
| Mo, 14% Re | 0.04 | n/a | 300 |
| ODS MO | 0.02 | 0.01 | 262 |

Figure 2:
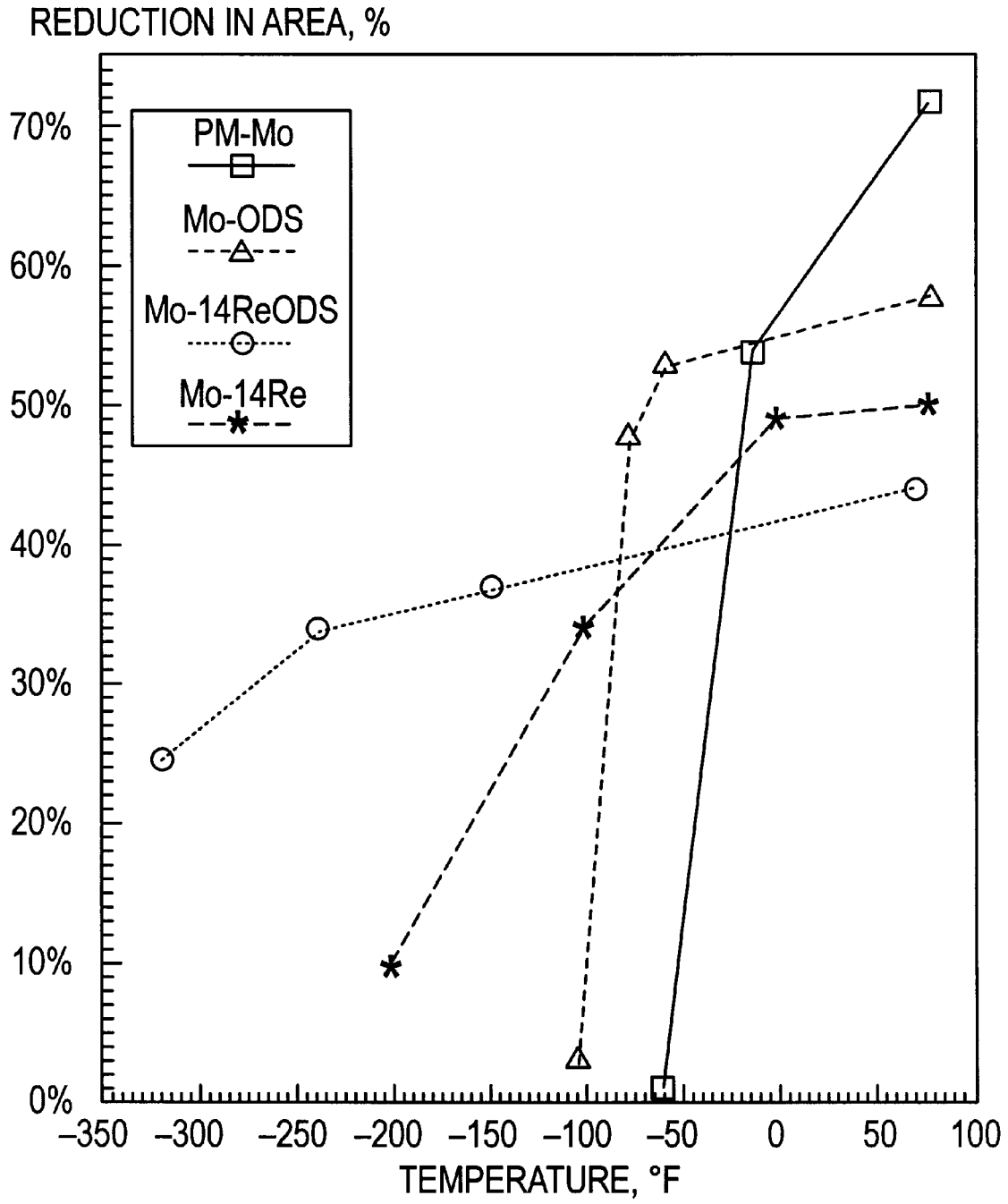
FIG. 2 illustrates a graph of the temperature versus reduction in area of worked molybdenum-base alloys.
Figure 3:
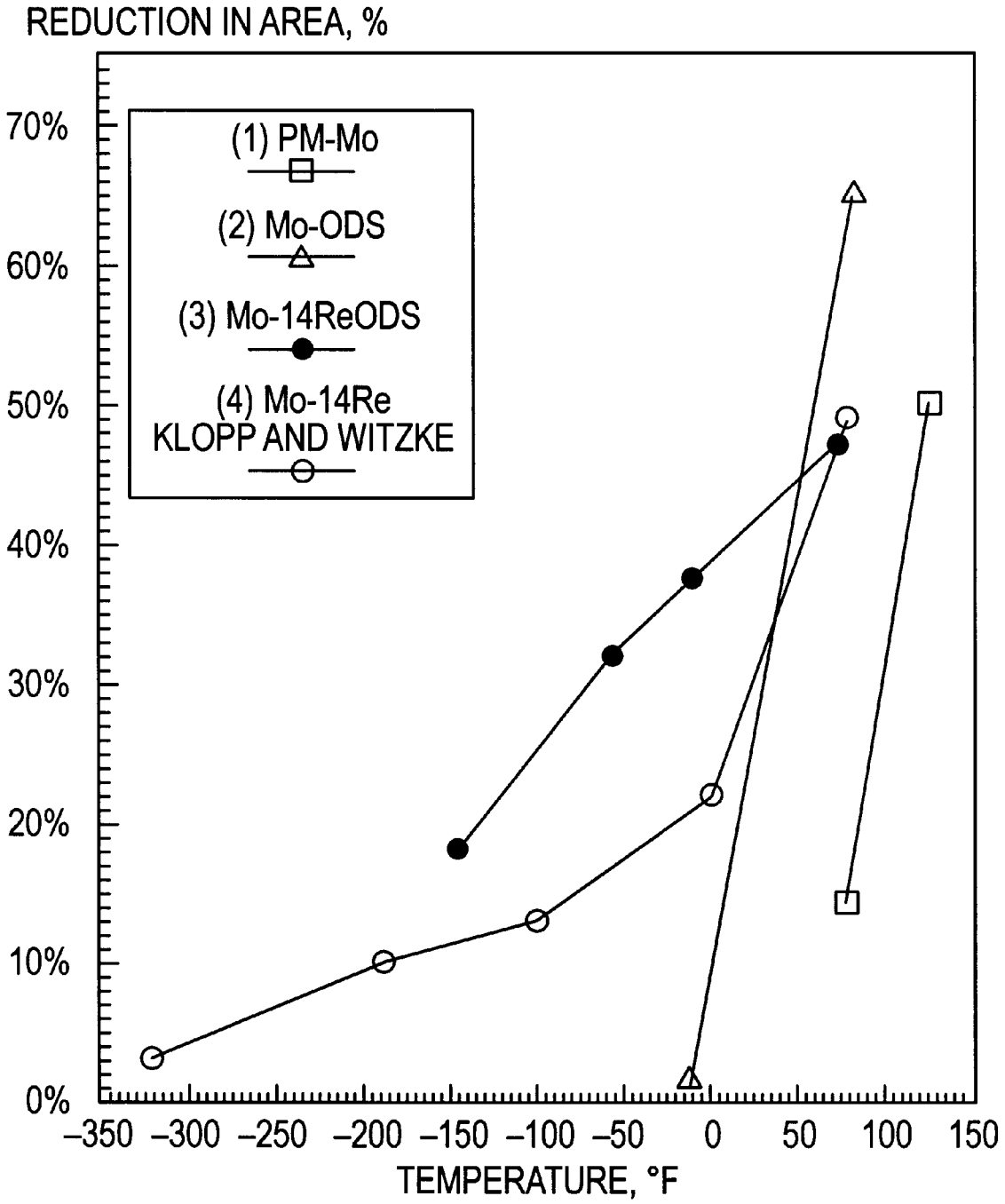
FIG. 3 illustrates a graph of the temperature versus reduction in area of recrystallized molybdenum-base alloys.

The room temperature yield stress and ultimate tensile stress, percent elongation to failure, reduction in area, and ductile-to-brittle transition temperature ("DBTT") for each alloy was measured and the results are shown in Table 4 and graphically in FIG. 1. The temperature at which the DBTT occurred was determined by examination of the fracture surfaces. The effect of temperature on the tensile reduction in area for molybdenum, Mo-14Re, and Mo-14Re-ODS alloys are presented in FIG. 2 for material tested in the worked and stress-relieved condition and in FIG. 3 for material in the recrystallized condition. The Mo-14Re-ODS alloy exhibited significantly better ductility than the Mo-14Re binary alloy both in the worked and stress relieved condition and in the recrystallized condition.

TABLE 4

| Alloy | 0.2% Offset Yield Stress (ksi) | Ultimate Tensile Stress (ksi) | Elongation to Failure (%) | Reduction in Area (%) | DBTT (° F.) |
|---|---|---|---|---|---|
| | | Swaged Alloys (>90% reduction in area) | | | |
| ODS Mo, 14% Re | 120 | 156 | 12 | 40 | −320 |
| ODS Mo, 7% Re | 86 | 129 | 13 | 42 | −240 |
| Unalloyed PM Mo | 78 | 90 | 15 | 72 | −10 |
| Mo, 14% Re | 123 | 130 | 13 | 50 | −150 |
| ODS Mo | 108 | 120 | 13 | 59 | −100 |
| | | Recrystallized Alloys | | | |
| ODS Mo, 14% Re | 50 | 105 | 27 | 38 | −58 |
| ODS Mo, 7% Re | 37 | 85 | 30 | 30 | 0 |
| Unalloyed PM Mo | 43 | 70 | 5 | 14 | 120 |
| Mo, 14% Re | 46 | 77 | 38 | 49 | 0 |
| ODS Mo | 53 | 76 | 29 | 65 | 75 |

The effect of oxide dispersion strengthening on the yield stress, ultimate tensile stress and DBTT of the Mo—Re alloys was unexpected. For molybdenum,0.2$T_m$ is 305° C. (581° F.) and as test temperatures are reduced below this value, the yield stress increases. As the DBTT is approached, the rate of increase is greater until the yield stress exceeds the fracture strength and failure is characterized by brittle fractures. The slopes of the yield stress curves for unalloyed molybdenum and Mo-ODS are similar even though the Mo-ODS has a higher yield stress. The addition of 14 wt. % rhenium to molybdenum decreased the temperature, at which the yield stress begins to increase, to approximately −20° C. (−4° F. or 0.09 $T_m$). Below −20° C. the rate of yield stress increase is similar to pure molybdenum. The change in slope below −80° C. (−110° F.) is a result of the fracture changing from predominantly ductile to predominantly brittle in nature. The combination of the 14 wt. % rhenium addition and oxide dispersion strengthening ("ODS") further lowers the transition temperature, where the flow stress becomes temperature dependent, to −100° C. (−148° F. or 0.06 $T_m$).

Figure 4:
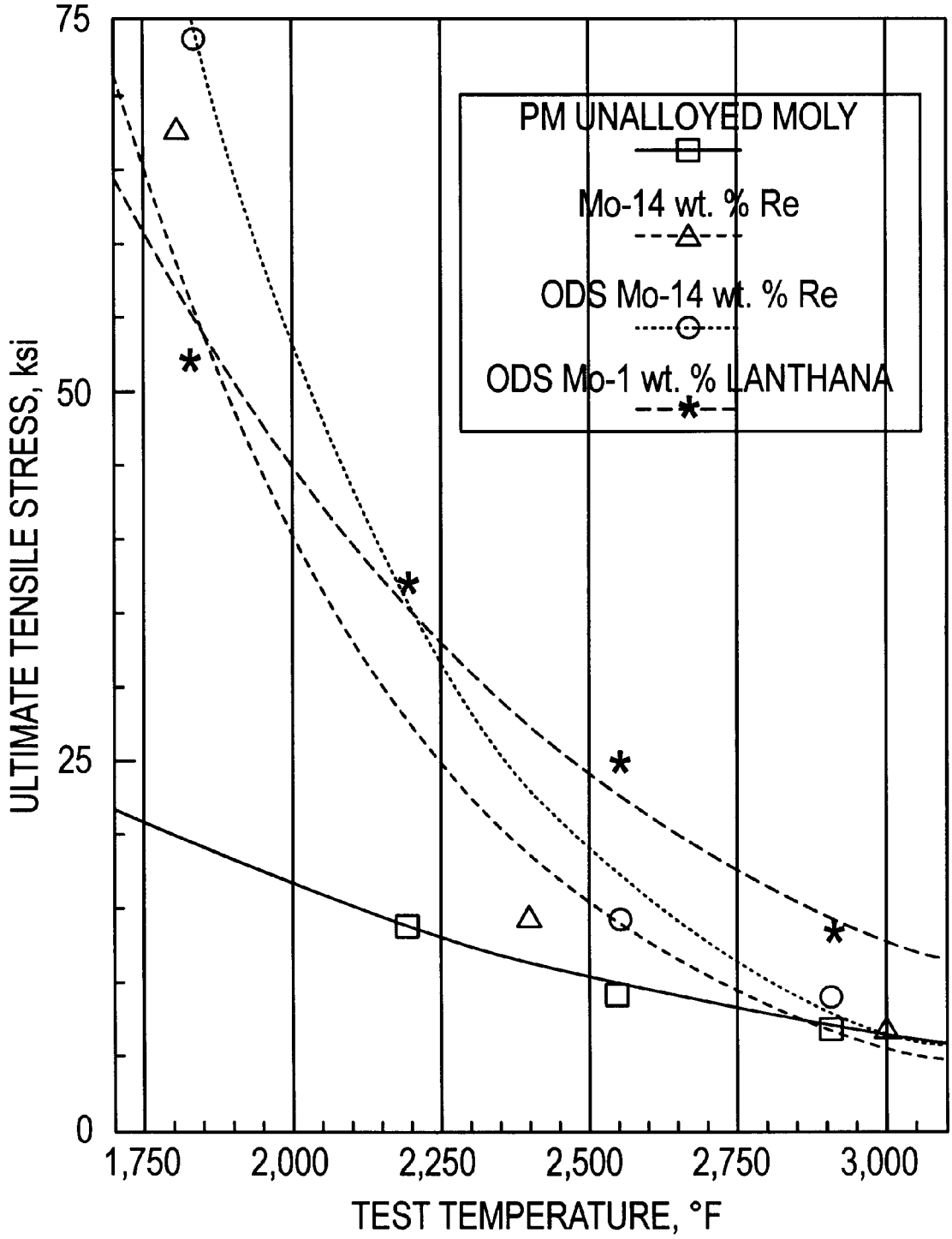
FIG. 4 illustrates a graph of ultimate tensile strength versus temperature of ODS molybdenum alloys and unalloyed molybdenum.

The elevated temperature tensile properties of the swaged and stress-relieved alloys were measured by uniaxially loading a round bar tensile specimen to failure in a dynamic vacuum ($<5\times10^{-5}$ torr) at temperatures ranging between 1000° C. and 1600° C. (1830°–2910° F.). The yield and ultimate tensile stress, percent elongation to failure, and the reduction in area were determined over the range of test temperatures. A graphic comparison of the ultimate tensile stress of the Mo-14Re-ODS alloy with unalloyed molybdenum, a Mo-14Re alloy, and a Mo-ODS alloy is presented in FIG. 4. The Mo-14Re-ODS alloy exhibited the highest UTS of the four between 1000° C. and 1250° C. (1830°–2280° F.).

The time dependent deformation of the Mo-14Re-ODS alloy is significantly better than the binary Mo-14 Re alloy. The addition of 14 wt. % Re to Mo does not appear to have any negative effect on the creep rupture behavior of Mo. The Mo-14Re-ODS alloy evaluated at 1000° C. (1830° F.) and 30 ksi ruptured after 137 hours. This compares with a rupture life of 0.05 hours for unalloyed molybdenum and 0.5 hours for Mo-14Re tested under the same conditions.

By adding rhenium, enhancements in the low temperature ductility of oxide dispersion strengthened molybdenum alloys were realized. In Mo—Re alloys, additions of rhenium suppressed the temperature dependent component of the flow stress. It has now been found that additions of rhenium in combination with oxide dispersion strengthening ("ODS") appear to surprisingly enhance this behavior.

Test Methods

Tensile and creep rupture specimens were machined from the 0.180 inch diameter rod. Specimens were electropolished at room temperature in a solution of four parts concentrated reagent grade sulfuric acid and one part distilled or deionized water, using a 0.010 inch thick Type 304 stainless steel cathode and a dc voltage of 6–7 volts to remove from 0.002 to 0.003 inches from the gauge section diameter.

Samples were removed from each end of the swaged rods for light optical metallographic examination and Vickers hardness measurements. A longitudinal and transverse orientation of each specimen was prepared by sectioning, mounting in Bakelite, and polishing through a series of declining grit sizes. The final relief polish used was 0.05 micron alumina powder. The mounts were swab etched with Murakami's etchant (10 grams potassium ferricyanide, 10 grams potassium hydroxide, and 100 milliliters distilled water). The average grain size of the final rod product was measured using the linear intercept method, per ASTM Standard E89. The average size and shape of the oxide particles was determined from unetched optical micrographs using a similar method. A minimum of five Vickers hardness (VHN) determinations were made across each specimen using an automated hardness tester, a Wilson Tukon Series 200. A diamond indenter with a five kilogram load and a ten second dwell time was used.

The following mechanical properties were measured for the ODS molybdenum-rhenium alloys: (a) 0.2% offset yield stress, (b) ultimate tensile stress, (c) percent reduction in area, and (d) total elongation to failure. The ductile-to-brittle transition temperatures (DBTT) of the swaged and recrystallized (one hour vacuum anneal at 1600° C. or 2910° F.) alloys were measured by uniaxially loading a round bar tensile specimen to failure at temperatures ranging from +200° C. to −196° C.(+390° to −320° F.) per ASTM Standards E8 and E21 at a strain rate of 0.05 $min^{-1}$ (0.00083 $sec^{-1}$).

The elevated temperature tensile properties of the swaged and recrystallized alloys were measured by uniaxially loading a round bar tensile specimen to failure in dynamic vacuum ($<5\times10^{-5}$ torr) at temperatures ranging from 1000° C. to 1600° C.(1830° to 2910° F.) and a strain rate of 0.05 $min^{-1}$ (0.00083 $sec^{-1}$). The fracture surface of each tensile specimen was evaluated with a scanning electron microscope (SEM), Amray Model 1810, to identify the mode of fracture; i.e., ductile or dimpled, cleavage, intergranular, or mixed-mode.

The creep behavior of this new alloy was also evaluated via constant load uniaxial creep tests at 1000° C. (1830° F.) and at 1600° C. (2910° F.) in dynamic vacuum ($<10^{-6}$ torr). A round bar creep rupture specimen in the swaged condition was pin loaded into the creep test vacuum chamber. The system was sealed, baked-out for fourteen hours under dynamic vacuum at 225° C. (437° F.) to remove all adsorbed moisture and gases from all internal surfaces, and subsequently leak rate checked. The test specimen was initially heated to the desired test temperature and held for thirty minutes with no load on the specimen. An initial length measurement between the shoulders of the specimen was made optically for reference. The initial load was then applied, and the first strain measurement was made. Strain measurements were taken at frequent intervals to define the creep deformation behavior of the specimen. The fracture surfaces of ruptured specimens were analyzed with the SEM to identify the type of fracture.

While the invention has been described in detail and with reference to specific embodiments thereof, it will be apparent to those of ordinary skill in the art that various changes and modifications can be made to the claimed invention without departing from the spirit and scope thereof.

What is claimed is:

1. A method of forming a molybdenum-rhenium alloy having enhanced strength and improved ductile-to-brittle transition temperatures, comprising the steps of:

(a) forming a slurry comprising molybdenum oxide and a metal salt dispersed in an aqueous medium, said metal salt being selected from nitrates or acetates of lanthanum, cerium or thorium;

(b) heating said slurry in the presence of hydrogen to form a molybdenum powder comprising molybdenum and an oxide of the metal salt;

(c) mixing rhenium powder with said molybdenum powder to form a molybdenum-rhenium powder;

(d) pressing said molybdenum-rhenium powder to form a molybdenum-rhenium compact;

(e) sintering said molybdenum-rhenium compact in the presence of hydrogen or under a vacuum to form a molybdenum-rhenium ingot; and (f) compacting said molybdenum-rhenium ingot to reduce the cross-sectional area of said molybdenum-rhenium ingot and form said molybdenum-rhenium alloy containing said metal oxide.

2. A method according to claim 1, wherein said metal salt is lanthanum nitrate or lanthanum acetate.

3. A method according to claim 2, wherein said metal salt is added in an amount which provides from about 2% to about 6% by volume lanthanum oxide in said molybdenum-rhenium alloy, based on total volume of said molybdenum-rhenium alloy.

4. A method according to claim 2, wherein said metal salt is added in an amount which provides from about 2% to about 4% by volume lanthanum oxide in said molybdenum-rhenium alloy, based on total volume of said molybdenum-rhenium alloy.

5. A method according to claim 1, wherein a total reduction in said cross-sectional area is at least about 90%.

6. A method according to claim 1, wherein a total reduction in said cross-sectional area is at least about 98%.

7. A method according to claim 1, wherein said rhenium is added in an amount from about 5% to about 25% by weight or less, based on total weight of said molybdenum-rhenium alloy.

8. A method according to claim 1, wherein said rhenium is added in an amount from about 7% to about 14% by weight or less, based on total weight of said molybdenum-rhenium alloy.

9. A method according to claim 1, wherein said compacting step comprises compacting said molybdenum-rhenium ingot using an extrusion press.

10. A method according to claim 9, further comprising the step of placing the molybdenum-rhenium ingot in an extrusion canister before compacting said molybdenum-rhenium ingot.

11. A method according to claim 9, wherein said compacting step further comprises hand swaging said molybdenum-rhenium ingot.

12. A method according to claim 1, wherein said pressing step comprises cold isostatically pressing said molybdenum-rhenium powder.

13. A method according to claim 1, wherein said mixing step comprises ball-milling said molybdenum powder and said rhenium powder.

14. A method according to claim 1, wherein said step (b) is conducted at a temperature of from about 600 to about 1300° C. for from about 6 to about 24 hours.

15. A method according to claim 1, wherein said step (b) is conducted at a temperature of from about 1200 to about 1275° C. for from about 6 to about 24 hours.

16. A molybdenum-rhenium alloy having enhanced strength and improved ductile-to-brittle transition temperatures, comprising molybdenum, rhenium and a metal oxide selected from oxides of lanthanum, cerium or thorium, said molybdenum-rhenium alloy being formed by the method comprising the steps of:

(a) forming a slurry comprising molybdenum oxide and a metal salt dispersed in an aqueous medium, said metal salt being selected from nitrates or acetates of lanthanum, cerium or thorium;

(b) heating said slurry in the presence of hydrogen to form a molybdenum powder comprising molybdenum and said metal oxide;

(c) mixing rhenium powder with said molybdenum powder to form a molybdenum-rhenium powder;

(d) pressing said molybdenum-rhenium powder to form a molybdenum-rhenium compact;

(e) sintering said molybdenum-rhenium compact in the presence of hydrogen or under a vacuum to form a molybdenum-rhenium ingot; and (f) compacting said molybdenum-rhenium ingot to reduce the cross-sectional area of said molybdenum-rhenium ingot and form said molybdenum-rhenium alloy containing said metal oxide.

17. A molybdenum-rhenium alloy according to claim 16, wherein said metal oxide is lanthanum oxide.

18. A molybdenum-rhenium alloy according to claim 17, wherein said molybdenum-rhenium contains from about 2% to about 6% by volume lanthanum oxide, based on total volume of said molybdenum-rhenium alloy.

19. A molybdenum-rhenium alloy according to claim 17, wherein said molybdenum-rhenium contains from about 2% to about 4% by volume lanthanum oxide, based on total volume of said molybdenum-rhenium alloy.

20. A molybdenum-rhenium alloy according to claim 16, wherein a total reduction in said cross-sectional area is at least about 90%.

21. A molybdenum-rhenium alloy according to claim 16, wherein a total reduction in said cross-sectional area is at least about 98%.

22. A molybdenum-rhenium alloy according to claim 16, wherein said rhenium is present in an amount from about 5% to about 25% by weight or less, based on total weight of said molybdenum-rhenium alloy.

23. A molybdenum-rhenium alloy according to claim 16, wherein said rhenium is present in an amount from about 7% to about 14% by weight or less, based on total weight of said molybdenum-rhenium alloy.

24. A molybdenum-rhenium alloy according to claim 16, wherein said compacting step comprises compacting said molybdenum-rhenium ingot using an extrusion press.

25. A molybdenum-rhenium alloy according to claim 24, wherein said compacting step further comprises hand swaging said molybdenum-rhenium ingot.

26. A molybdenum-rhenium alloy according to claim 17, wherein said pressing step comprises cold isostatically pressing said molybdenum-rhenium powder.

27. A molybdenum-rhenium alloy according to claim 17, wherein said mixing step comprises ball-milling said molybdenum powder and said rhenium powder.

28. A molybdenum-rhenium alloy according to claim 17, wherein said step (b) is conducted at a temperature of from about 600 to about 1300° C. for from about 6 to about 24 hours.

29. A molybdenum-rhenium alloy according to claim 17, wherein said step (b) is conducted at a temperature of from about 1200 to about 1275° C. for from about 6 to about 24 hours.

30. A molybdenum-rhenium alloy according to claim 17, wherein said molybdenum-rhenium alloy has an ultimate tensile stress of greater than 120 ksi in combination with a ductile-to-brittle transition temperature of below −100° F.

31. A molybdenum-rhenium alloy according to claim 17, wherein said molybdenum-rhenium alloy has an ultimate tensile stress of at least about 129 ksi in combination with a ductile-to-brittle transition temperature of below −200° F.

32. A molybdenum-rhenium alloy according to claim 17, wherein said molybdenum-rhenium alloy has an ultimate tensile stress of at least about 150 ksi in combination with a ductile-to-brittle transition temperature of below −300° F.

* * * * *